US011229270B2

(12) United States Patent
Kuo

(10) Patent No.: US 11,229,270 B2
(45) Date of Patent: Jan. 25, 2022

(54) SHAVING APPLICATOR DEVICE

(71) Applicant: Youti Kuo, Penfield, NY (US)

(72) Inventor: Youti Kuo, Penfield, NY (US)

( * ) Notice: Subject to any disclaimer, the term of this patent is extended or adjusted under 35 U.S.C. 154(b) by 102 days.

(21) Appl. No.: 16/630,946

(22) PCT Filed: May 1, 2019

(86) PCT No.: PCT/US2019/030167
§ 371 (c)(1),
(2) Date: Jan. 14, 2020

(87) PCT Pub. No.: WO2020/013906
PCT Pub. Date: Jan. 16, 2020

(65) Prior Publication Data

US 2021/0227948 A1 Jul. 29, 2021

Related U.S. Application Data

(60) Provisional application No. 62/695,170, filed on Jul. 8, 2018.

(51) Int. Cl.

| | |
|---|---|
| ***A45D 27/04*** | (2006.01) |
| ***A45D 34/04*** | (2006.01) |
| ***B26B 19/40*** | (2006.01) |
| *A45D 34/00* | (2006.01) |

(52) U.S. Cl.
CPC ..... *A45D 27/04* (2013.01); *A45D 34/041* (2013.01); *B26B 19/40* (2013.01); *A45D 2034/005* (2013.01); *A45D 2200/056* (2013.01)

(58) Field of Classification Search
CPC ..... A45D 27/04; A45D 34/041; B26B 19/40
See application file for complete search history.

(56) References Cited

U.S. PATENT DOCUMENTS

| | | | | |
|---|---|---|---|---|
| 5,402,697 | A * | 4/1995 | Brooks | B26B 19/40 30/34.2 |
| 5,564,190 | A | 10/1996 | Fleetwood | |
| 5,638,601 | A | 6/1997 | Mol et al. | |
| 7,051,439 | B2 | 5/2006 | Tomassetti | |
| 8,888,394 | B2 * | 11/2014 | Caulier | B05C 17/0308 401/219 |
| 2014/0153996 | A1 * | 6/2014 | Ammerman | A45D 34/041 401/219 |
| 2015/0121704 | A1 | 5/2015 | Bridges et al. | |
| 2018/0228268 | A1 * | 8/2018 | Megaro | B05B 11/3001 |

* cited by examiner

*Primary Examiner* — Omar Flores Sanchez
(74) *Attorney, Agent, or Firm* — McClure, Qualey & Rodack, LLP

(57) ABSTRACT

A shaving applicator device provided with a shaving lubricant dispenser and an applicator head for applying lubricant directly on skin without hand touching the lubricant. The applicator head consists of a flow channel shaft, a roller having two end wheels and a rubber sleeve having self-closing slits. Under a pumping pressure, the lubricant emerges from the slits to spread on the roller surface. Gliding the roller on skin surface can spread the lubricant on the skin evenly with predetermined thickness. The dispenser may contain shaving foam, gel or liquid. For shaving liquid, foaming meshes are installed in the flow channel shaft for generating foam. Additionally, a combination shaver including a shaving lubricant dispenser, an applicator head and a razor unit is provided. In the combination shaver the razor unit and the applicator head are positioned in parallel back to back with a clearance.

12 Claims, 6 Drawing Sheets

SHAVING APPLICATOR DEVICE

CROSS REFERENCE TO RELATED APPLICATION

This application claims priority to U.S. Provisional Application No. 62/695,170, filed Jul. 8, 2018, the disclosure of which is hereby incorporated by reference in its entirety.

BACKGROUND

Field of Invention

This invention relates to a shaving applicator for directly applying shaving lubricant on skin and a combination shaver having the shaving applicator integrated with a replaceable razor unit and a replaceable shaving dispenser.

Description of Related Art

In conventional wet shaving, two hands are required to apply shaving lubricant on skin. A user uses one hand holding a shaving lubricant dispenser to dispense the lubricant to the other hand, and subsequently uses this other hand to apply the lubricant on his or her skin for shaving. This two hand actions repeat a number of times until the targeted skin is wholly covered by the lubricant. In the process non-targeted areas are covered with the lubricant by swiping hand motion and extra lubricant is wasted due to uneven layer applied on the skin. It is also likely that the user would rinse the lubricant off from his or her hand before the actual shaving action. Therefore, it is desirable to have a shaving applicator device that integrates a shaving applicator head with a shaving lubricant dispenser for applying the lubricant directly on a user's skin with one hand operation. It is also desirable that the structure of a shaving applicator device is applicable to shaving foam, gel or liquid. It is further desirable to have a combination shaving device that integrates a shaving applicator device with a razor unit for convenience of shaving and for portability. In such a combination shaving device, the structures of the razor unit and the shaving applicator should not interfere with each other's function.

US Patent Application No. 20150121704 by Bridges et al. describes a razor device for dispensing a fluid during shaving. The handle of the razor device includes a cavity for housing a reservoir of fluid and a manually-actuated pump to dispense the fluid to apertures located at the bottom of razor blades. The shaving device of this invention uses the shaving surface of the blades to spread the fluid on the skin. This application method is of high risk as it requires delicate finger action to avoid cutting on the skin. Additionally, after each dispensing action shaving motion must follow immediately in the wetted area before the fluid flows down in the gravity direction.

U.S. Pat. No. 7,051,439 by Tomassetti discloses a combination shaver device having a razor unit attached with a replaceable shaving foam cartridge. The shaving foam is discharged from a nozzle opening onto hand for transferring onto the user's skin for shaving. The objective of the shaver device is solely for the convenience of carry on, not for directly applying shaving foam on skin.

For directly applying a shaving lubricant on skin, U.S. Pat. No. 5,564,190 by Fleetwood provides a combined shaver and shaving lubricant dispenser. Extending from the dispenser is a flow manifold in connection with a planar dispensing surface, which includes five dispensing apertures. Although it can be used as an applicator to distribute the shaving lubricant on skin, the dispensing surface is stationary that, when gliding on the skin, it can cause the shaving lubricant be pushed to the dead corner below the planar surface. The shaving lubricant accumulated at the dead corner becomes a waste as it cannot be re-deposited on the skin by the movement of the planar surface itself. The shaving lubricant at the dead corner can be manually swiped away to re-apply on the skin but this extra step is inconvenient and unsatisfactory for a shaving applicator.

Similarly, U.S. Pat. No. 5,638,601 by Mol, et al. provides a shaver having a spreading surface for distributing shaving cream and gel. Used as an applicator, the spreading surface of the shaver device is foldable for protecting the razor unit when not used. The flat-surface applicator has the same disadvantage of the U.S. Pat. No. 5,564,190 that the shaving lubricant can be accumulated below the spreading surface instead of being distributed on the skin. It requires another hand to pickup the lubricant under the spreading surface to reapply it on the skin. In other words, the shavers of all of the prior art patents require use of one hand hold a shaver and another hand apply shaving lubricant on the skin.

The cited references are shown in the table below:

| Cite No. | Publication Number | Publication Date | Name of Applicant | Relevant passages (pages, lines) |
|---|---|---|---|---|
| 1 | U.S. patent application No. 20150121704 | May 7, 2015 | Bridges et al. | Page1, Abstract |
| 2 | U.S. Pat. No. 7,051,439 | May 30, 2006 | Tomassetti | Page1, Abstract |
| 3 | U.S. Pat. No. 5,564,190 | Oct. 15, 1996 | Fleetwood | Page1, Abstract |
| 4 | U.S. Pat. No. 5,638,601 | Jun. 17, 1997 | Mol, et al. | Page1, Abstract |

SUMMARY

It is an object of the invention to apply shaving foam or gel directly on skin without extra step of transfer by hand. It is another object of the invention to apply uniform layer on skin without wasting extra foam or gel. It is another object of the invention to have the apertures of the shaving applicator self-closed when not in use for preventing leaking and drying of shaving lubricant. It is a further object of the invention to combine a razor unit, a dispenser and a shaving applicator in one unit for convenience. It is further object to have replaceable shaving cartridge and replaceable razor unit.

A shaving applicator device is provided with a shaving lubricant dispenser and an applicator head. The applicator head consists of a flow channel shaft and a roller having two end wheels and a rubber sleeve with self-closing slits. The roller is free to rotate on the flow channel shaft. The space between the flow channel shaft and the rubber sleeve forms a chamber for filling the lubricant that is pumped from the lubricant dispenser through the openings in the flow channel shaft. Under a pumping pressure, the lubricant exits from the slits of the rubber sleeve to spread on the roller surface. The lubricant on the roller surface then can be directly applied on skin by driving the roller on the skin. The thickness of the shaving lubricant layer left on the skin is created by the design that the outside diameter of the end wheels is slightly larger than the outside diameter of the rubber sleeve for forming a gap between the roller surface and the skin when the wheels placed on the skin. Additionally, for evenly spreading the shaving lubricant on the skin, a pattern of slit openings are cut through the roller annular wall for exiting the shaving lubricant under a pumping pressure. The slit openings close by the resiliency of the rubber sleeve to its original shape upon the release of the pumping pressure when the dispenser is not actuated. As the dispenser is pressed, actuated or pumped, streams of the shaving lubricant emerge from the multiple slit openings simultaneously around the roller. A user can roll the applicator on his or her skin to spread the shaving lubricant. With repeated pumping the dispenser as needed, the whole targeted skin area can be covered with the shaving lubricant for shaving with a razor. The whole operation from pumping the dispenser to spreading the shaving lubricant on the skin can be accomplished with one hand.

In addition to using an aerosol shaving foam dispenser or a shaving gel dispenser, one specific configuration of the device of the present invention is the use of a mechanical dispenser storing a liquid shaving lubricant and a flow channel shaft that contains a foaming mesh. When the mechanical dispenser is actuated, the liquid lubricant is pumped to the flow channel shaft and forced to pass through the foaming mesh at high shear to generate foam. Then the foam exits at the slit openings to spread around the outer surface of the rubber sleeve ready to be applied on the skin. The operation of the shaving applicator using the mechanical foam dispenser is similar to that of an aerosol shaving foam dispenser or that of a shaving gel dispenser.

Furthermore, this invention also provides a combination shaver that includes a shaving lubricant dispenser, an applicator head, and a razor unit. In this all-in-one shaver configuration, a razor unit is mounted on a unitary neck, which contains a flow channel connecting to the outlet of the dispenser and to the inlet of the flow channel shaft of the applicator. The razor unit is separated from the applicator head with a clearance for not interfering with the rotation of the roller when having shaving lubricant on its surface. Moreover, the shaving side of the razor unit is opposite to the side applying the lubricant by the applicator head. Both the razor unit and the dispenser are replaceable.

BRIEF DESCRIPTION OF THE DRAWINGS

FIG. 1*c*-1 is a lubricant inside the roller of the shaving applicator device shown in FIG. 1*a;*

FIG. 1*c*-2 is a lubricant exiting radially from the roller;

FIG. 1*c*-3 is a lubricant spreading on the roller surface;

FIG. 2 is a shaving applicator device having a shaving gel dispenser and an applicator head;

FIG. 3 is a shaving applicator device having a shaving liquid dispenser and an applicator head having foaming meshes;

DETAILED DESCRIPTION

Figure 1B:
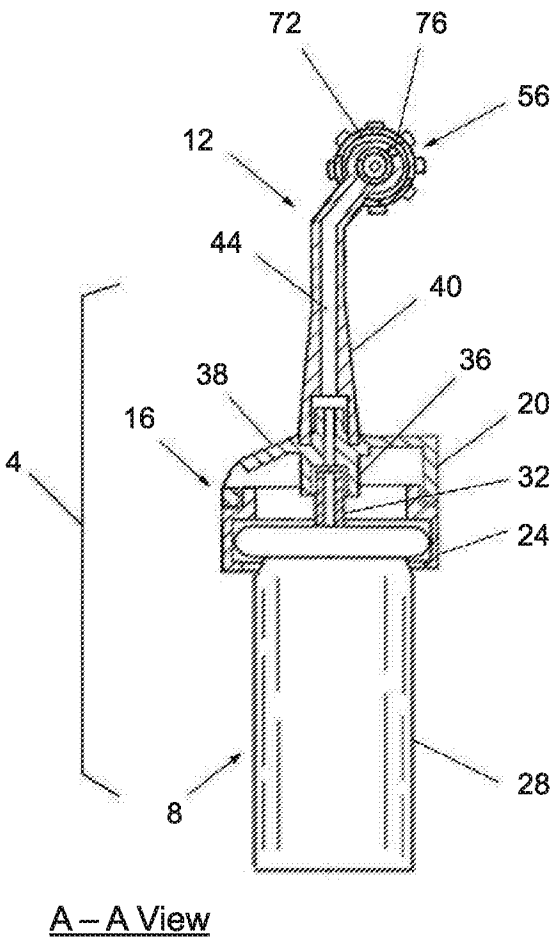
FIG. 1*b* is a side view of the shaving applicator device shown in FIG. 1*a;*

Throughout the following detailed descriptions, same reference numerals refer to the same elements in all figures.

Figure 1A:
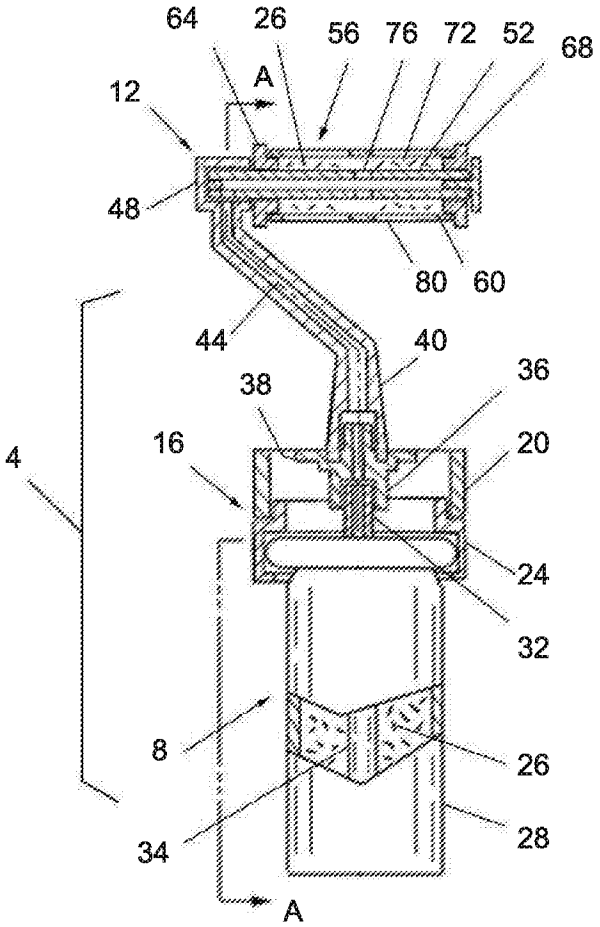
FIG. 1*a* is a shaving applicator device having a shaving foam dispenser and an applicator head (Front View)
Figures 1, 1C, 2, 3:
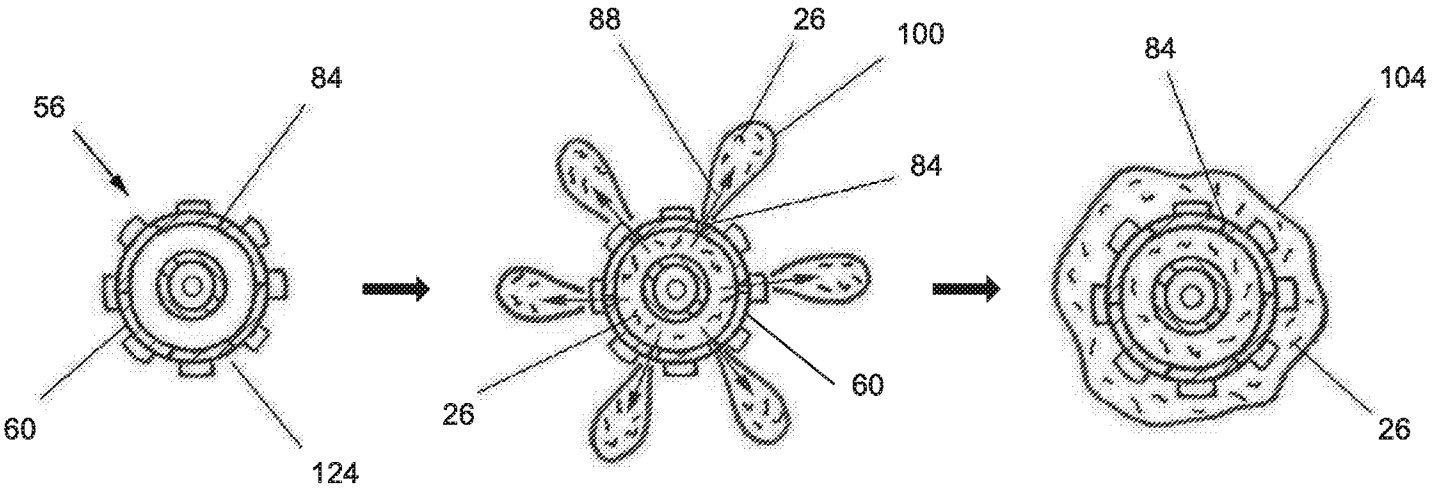
Figure 1D:
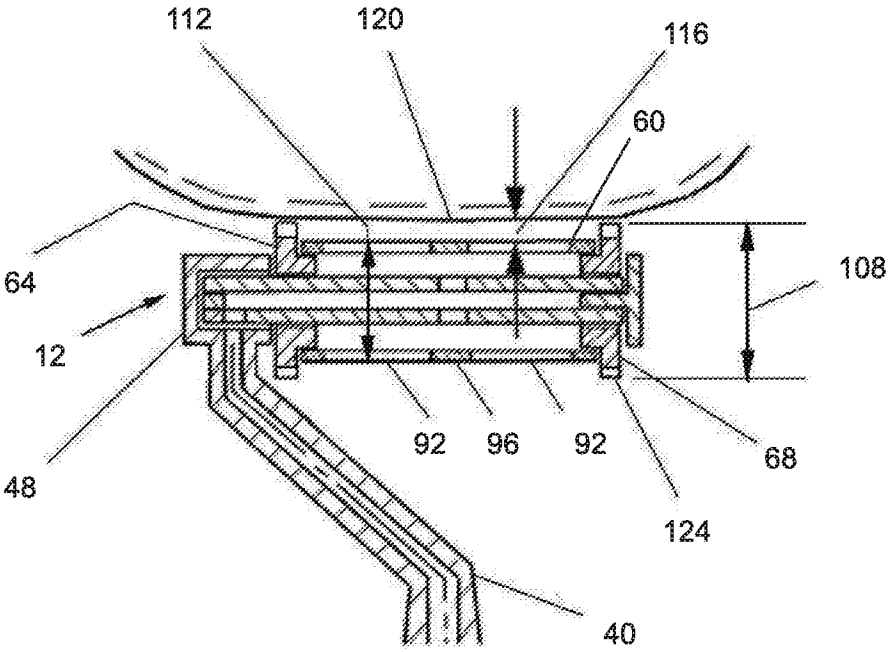
FIG. 1*d* is a gap between the roller sleeve and two wheels in contact with skin.
Figure 2:
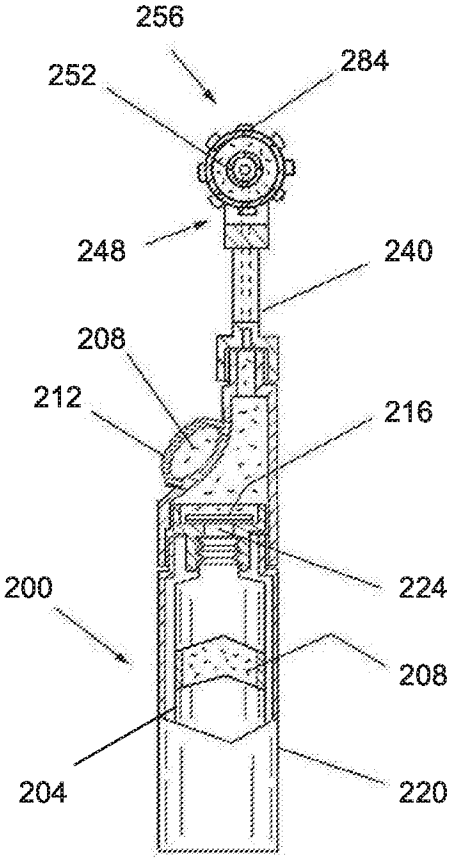
Figure 3:
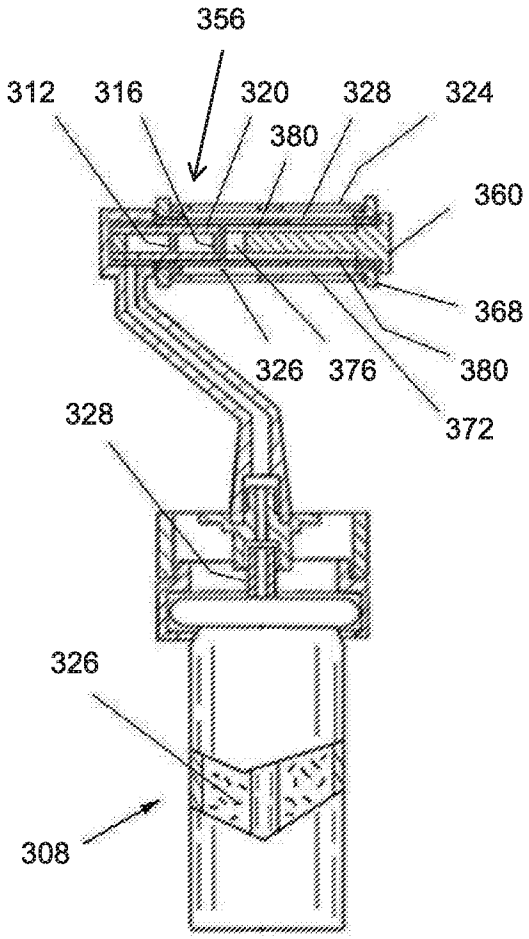

The structure and the function of a shaving applicator device of the present invention are described in details as follows. As shown in FIGS. 1*a*, 1*b*, a shaving applicator device 4 of the present invention includes shaving lubricant dispenser 8, shaving applicator 12, and housing 16, which has upper frame 20 and lower frame 24 supporting dispenser 8 and applicator 12 respectively. Dispenser 8 includes cartridge 28 containing shaving lubricant 26, nozzle 32, dip tube 34, and actuator 36 having lever 38. Applicator 12 has neck 40 including flow channel 44 extending from nozzle 32 to applicator head 48. Applicator head 48 includes flow channel shaft 52 receiving lubricant 26 from dispenser 8 and roller 56 for exiting the lubricant through openings on its surface. Roller 56 has annular wall 60 mounted between a proximal end-cap wheel 64 and distal end-cap wheel 68 that together forms chamber 72 encompassing flow channel shaft 52. End wheels 64, 68 are mounted on flow channel shaft 52 with sealing-fit and free to rotate. Flow channel shaft 52 is in flow communication with the flow channel 44 in neck 40 and has outlet openings 76 to fill chamber 72 with lubricant 26 pumped from dispenser 8. And annular wall 60 has an array of openings 80 through the thickness of the wall, which are spaced apart to distribute the lubricant evenly on the outer surface. In a preferred embodiment annual wall 60 is a resilient rubber sleeve with openings formed by slit cuts 84 as shown in FIG. 1*c*-1, which shows roller 56 in FIG. 1*b*. The slits are forced to open, as shown in FIG. 1*c*-2, to exit the lubricant under a pumping pressure, represented by arrows 88, created by pressing on actuator 36 of the dispenser to force the flow of lubricant 26 from cartridge 28 to flow channel shaft 52 to chamber 72. FIG. 1*c*-2 also shows jetting 100 of the lubricant at the slit openings under a pumping pressure. Slits 84 can close by themselves due to the resiliency of the rubber material when the pumping pressure is reduced or removed upon the release of actuator 36 from a depressed position. In a preferred embodiment, as shown in FIG. 1*c*-2, slits 84 can be cut at 60*o* apart along the circumference of rubber sleeve, i.e. annular wall 60. In a preferred embodiment as shown in FIG. 1*d*, rubber sleeve 60 has two slit segments 92, which are spaced along the axial direction, and an un-cut segment 96 in between to maintain the rigidity and strength of the rubber material for self-closing and returning to the original un-deformed state of the rubber sleeve. At the end of pump action the jetting becomes spreading 104 on the rubber sleeve surface due to fluidity, surface tension and gravity of the lubricant. The objective of using the self-closing slits is preventing drying in case of using shaving gel and preventing oozing in using shaving foam. For shaving foam, the foam may slowly oozing out of openings on the roller surface if the openings are not closed due to remaining foam pressure inside the chamber when the actuator is released or the pumping action is stopped. The self-closing of the slit openings due to the elastic force of the rubber sleeve keeps the shaving foam inside the chamber and preventing any contaminants from entering the chamber.

In a further embodiment of the present invention, referring to FIG. 1*d*, outside diameter 108 of proximal end-wheel 64 and distal end-wheels 68 is larger than outside diameter 112 of rubber sleeve 60 for forming gap 116 between the two wheels and the rubber sleeve when the two wheels are in contact with a flat surface or a user's skin 120. Each wheel has grooves 124, as shown in FIG. 1*c*-1 and FIG. 1*d*, for the ease of rotating roller 56. In application, after pumping the lubricant is forced out to spread on the surface of the rubber sleeve. When the roller is glided or driven on a user's skin, the lubricant fills up the gap to form a lubricant layer left on the skin. This swath of lubricant layer is nearly uniform. Repeated pumping can provide additional lubricant needed to cover the entire target area of the skin to be shaved. After shaving, rinsing of the roller can easily remove residual lubricant from the roller surface and keep the roller surface clean.

The configuration of applicator head 48 of the shaving applicator device as described above is applicable to a dispenser that contains shaving foam or shaving gel. Specifically, the dispenser as illustrated in FIGS. 1*a*, 1*b* may be for a shaving foam dispenser using a replaceable pressurized cartridge or an aerosol cartridge. The structure and function of a pressurized or aerosol dispenser is well known in the art. For using a shaving gel dispenser, FIG. 2 illustrates gel dispenser 200 using replaceable cartridge 204 containing shaving gel 208 and rubber button 212 with one-way valve 216 for pumping shaving gel 208. Cartridge 204 may be a rigid-tube type with a movable disc to compact the gel lubricant during pumping action. The function and configuration of such a rigid-tube type cartridge is similar to that used in a pump toothbrush as described in U.S. Pat. No. 7,789,583 by Kuo (cartridge 500 in FIG. 1*b* in the Kuo patent). FIG. 2 shows cartridge 204 be a collapsible-tube, like a conventional toothpaste tube, contained inside handle 220. When rubber button 212 is depressed, the pumping pressure causes one-way valve 216 to close on outlet 224 of cartridge 204 and force the gel inside the cavity to exit from slit openings 284 on roller 256 through flow channel shaft 252. The structures and the functions of slit openings 284, roller 256 and flow channel shaft 252 are similar to those described in FIG. 1*a* and FIG. 1*b*. Upon the release of the rubber button, a vacuum force is created inside the cavity that causes the slit openings to close and to move the gel from the cartridge to replenish the cavity. The structures and the functions of applicator head 248 and neck 240 are similar to those described in FIG. 1*a* and FIG. 1*b*.

Another embodiment of the shaving applicator device of the present invention is the use of non-pressurized mechanical dispenser containing shaving liquid lubricant for generating shaving foam. In such a mechanical foam dispenser, a foaming mesh having a net of fine through holes is installed in the outlet nozzle to apply high shear on the liquid lubricant passing through the nozzle. The technique of using foaming mesh in generating foam from liquid in a conventional mechanical dispenser is well known in the art.

However, in a preferred embodiment, as shown in FIG. 3*b*, mechanical liquid dispenser 308 containing shaving liquid lubricant 326 is used in conjunction with placing coarse foaming mesh 312 and fine foaming mesh 316 in flow channel shaft 320. In such a configuration, the foam flow path from flow channel shaft 320 to slit openings 324 is much shorter than that for a mechanical foam dispenser, whose foam flow path would be from dispenser nozzle 328 to slit openings 324. As a result, the foam pressure with the use of foaming meshes inside flow channel shaft 320 is much higher and effective in producing higher density foam than that of placing forming meshes inside a conventional mechanical liquid dispenser. Furthermore, the chamber space 372 containing foam 326 is minimized to reduce the residual amount of foam remaining inside the chamber. This residual amount can be pushed out by the new foam generated from the foaming meshes inside the flow channel shaft.

Specifically, to minimize the amount of remaining foam inside the chamber, an annular perforated shaft sleeve 328 is press-fit onto the flow channel shaft 320, which is also named the proximal shaft here, to extend the effective length of shaft 320 in supporting roller 356. To this aim, distal shaft 360 is inserted into shaft sleeve 328 for supporting distal wheel 368. Distal shaft 360 has recess cavity 376 at its front end and a number of grooves 380 on its surface for flow connection. Recess cavity 376 allows the jetting of the foam flow from the foaming mesh in proximal shaft 320 to the grooves and to exit from slit openings 324. To avoid impeding the flow, the openings on perforated sleeve 328 and the groove positions are coincide with the slit openings 324, which are preferably 60 degree apart on the circumference of the roller. The front end of the distal shaft is in contact with the front end of the proximal shaft to maintaining the rigidity of shaft sleeve in supporting the roller. For maximizing foam generation slit openings 324 may be designed to stay open for not impeding the speed of the foam jet exiting the foaming mesh, which is a key factor in affecting the quality of foaming.

Figure 4C:
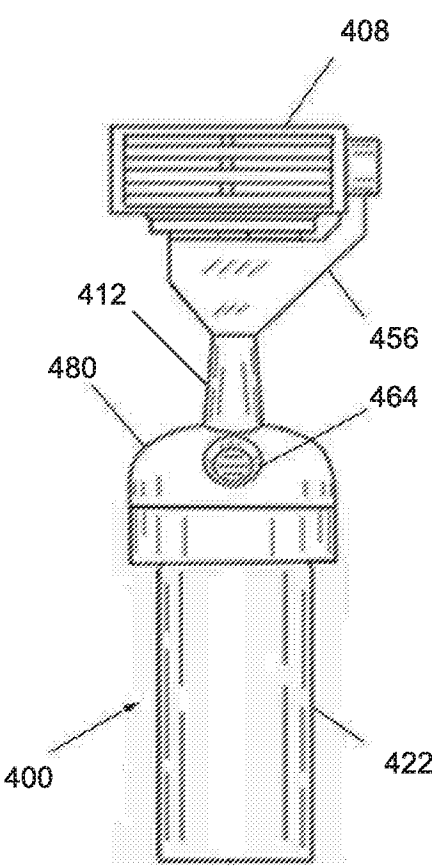
FIG. 4*c* is a rear view of the combination shaver device shown in FIG. 4*a*.
Figure 4B:
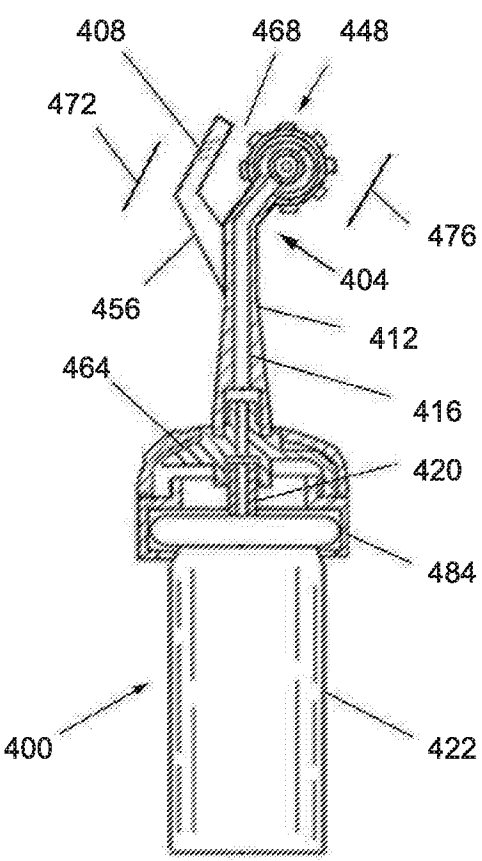
FIG. 4*b* is a side view of the combination shaver device shown in FIG. 4*a;*
Figure 4A:
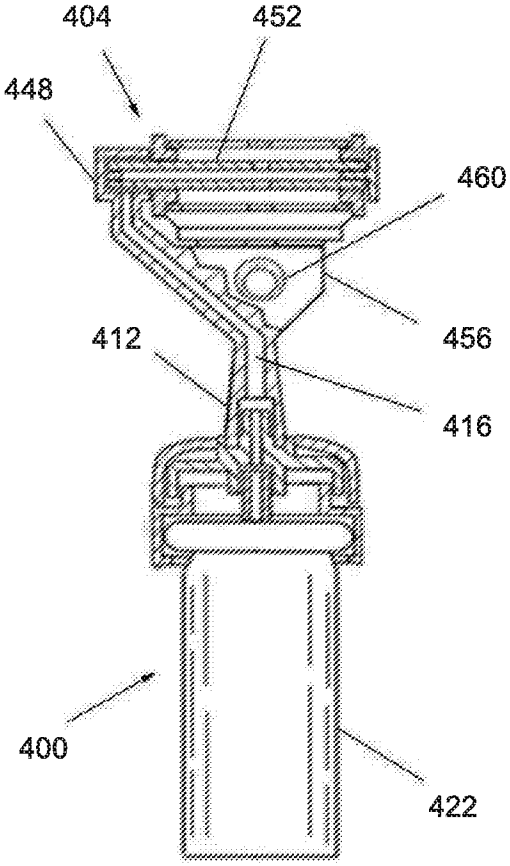
FIG. 4*a* is a combination shaver device having a dispenser, an applicator head, and a razor blade unit (Front View)

Another embodiment of the present invention is a combination shaver that combines a razor unit, a shaving lubricant dispenser, and a shaving applicator in one device. As shown in FIGS. 4*a*, 4*b* and 4*c* combination shaver 400 of the present invention is a shaving applicator device attached with replaceable razor unit 408 on unitary neck 412. One function of unitary neck 412 is providing a common support structure that contains flow channel 416, which connects with outlet nozzle 420 of dispenser 422 and flow channel shaft 452, and includes detachable mounting mechanism 456 for supporting a replaceable razor blade unit 408. Neck 416 moves with actuator 464 of dispenser 422 for pumping the shaving lubricant inside the dispenser. Razor blade unit 408 is positioned in parallel with applicator head 448 with clearance 468 between them such that the shaving side 472 of blade unit 408 is opposite to lubricant side 476 of applicator head 448. In practice, after using the shaving applicator to spread the shaving lubricant on targeted skin area, a user flips the combination shaver device to have the razor blade face the skin to shave. With the use of the combination shaver, the user can accomplish the actions of spreading the lubricant on skin and shaving in continuous movements by one hand without involving the other hand. Furthermore, in such continuous movement the user's hands do not touch the shaving lubricant, therefore, saving many mid steps needed in conventional shaving.

Further embodiment of the present invention is a pumping means of using a dome-shaped resilient rubber cap 480 as part of actuator 464 for pumping to avoid any rinsing water into the pumping mechanism of the shaving applicator device. FIG. 4*c* shows that a dome-shaped rubber cap 480 is attached to the base of neck 416 to cover lower frame 484 of the housing from water penetration. The underside of rubber cap 480 is bonded to rigid actuator 464 for depressing the neck to pump shaving lubricant inside dispenser 422. The resilient and elastic nature of the rubber cap can cause the neck to spring back to its original position when the dome-shape cap and actuator is released from a depressed position. The smooth surface of the rubber cap is easy for cleaning after using the shaver device.

It is within the scope of this invention that the concept and mechanisms of the shaving applicator device as described here may be applicable to other applications, such as applying cosmetics or medical treatment on skins. Also, for example, the applicator head may be a comb having orifices and the dispenser may contain hair dye for dyeing hairs. The applicator head may also deliver paints for painting with the self-closing slits preventing drying of the pains on the roller surface when not in use.

What is claimed is:

1. A shaving applicator device comprising:

a housing having a lower frame and an upper frame;

a lubricant dispenser attached to the lower frame of said housing, said dispenser having a cartridge containing a shaving lubricant and an actuator for dispensing said lubricant; and an applicator head attached to the upper frame of said housing being in flow communication with said dispenser, said applicator head comprising:

a flow channel shaft receiving said lubricant from said dispenser, said flow channel shaft having perforated wall; and a roller having an annular wall situated between a proximal end-cap and a distal end-cap forming a chamber encompassing said flow channel shaft for receiving said lubricant from said dispenser, said annular wall being made of a resilient elastomer material and having self-closing slits for exiting said lubricant when said actuator of said lubricant dispenser is depressed to apply a pumping pressure and for closing said slits when the pumping pressure is removed upon release of said actuator from a depressed position.

2. The shaving applicator device of claim 1, wherein said proximal end-cap and said distal end-cap are wheels being free to rotate on said flow channel shaft.

3. The shaving applicator device of claim 2, wherein the diameter of said proximal end-cap wheel and said distal end-cap wheel is larger than the outer diameter of the annular wall for forming a gap between said annular wall of said roller and a skin surface on which said two wheels being in contact.

4. The shaving applicator device of claim 3, wherein said gap allows for forming a layer of lubricant on the skin surface when said roller is glided on the skin surface with said lubricant dispensed on the outer surface of said annular wall.

5. The shaving applicator device of claim 1, wherein said flow channel shaft is covered by a sleeve of resilient elastomer material having self-closing slits for reducing foam pressure inside said chamber to prevent foam exuding from said annular wall.

6. The shaving applicator device of claim 1, wherein said lubricant being a shaving gel and said cartridge being is a non-pressurized tube.

7. The shaving applicator device of claim 1, wherein said dispenser being non-pressurized with said lubricant being in liquid form, and said roller includes a foaming mesh positioned inside said flow channel shaft for foam generation.

8. The shaving applicator device of claim 1, wherein said upper frame being attached with a razor blade unit forming a combination device having a detachable dispenser cartridge and a razor blade unit.

9. The shaving applicator device of claim 8, wherein said razor blade unit being positioned in parallel with said applicator head with a clearance such that the shaving side of the blade unit is opposite to the lubricant application side of said applicator head.

10. The shaving applicator device of claim 9, wherein said razor blade unit and said applicator head being mounted on a unitary neck, which contains a flow channel in communication with said dispenser and said flow channel shaft, said neck moves with said actuator of said dispenser.

11. The shaving applicator device of claim 2, wherein the outer surface of each wheel has grooves for facilitating the rotation of said roller for applying said lubricant on skin surface.

12. The shaving applicator device of claim 1, wherein said actuator of said dispenser is formed with a resilient cap, said resilient cap is depressed to dispense said lubricant, and said resilient cap returns to its original shape when released from a depressed position.

* * * * *